United States Patent [19]

Achtnig et al.

[11] Patent Number: 4,682,838

[45] Date of Patent: Jul. 28, 1987

[54] MULTIPOLAR PLUG

[75] Inventors: Klaus-Peter Achtnig; Herrman Herfort; Gunther Hegner, all of Berlin, Fed. Rep. of Germany

[73] Assignee: KRONE GmbH, Berlin, Fed. Rep. of Germany

[21] Appl. No.: 805,450

[22] Filed: Dec. 5, 1985

[30] Foreign Application Priority Data

Dec. 20, 1984 [DE] Fed. Rep. of Germany ..... 3446622

[51] Int. Cl.[4] ..... H01R 9/00

[52] U.S. Cl. ..... 439/598; 439/357; 439/696

[58] Field of Search ..... 339/176 P, 196 R, 196 M, 339/198 G, 198 H, 218 R, 220 R

[56] References Cited

U.S. PATENT DOCUMENTS

| | | | |
|---|---|---|---|
| 765,183 | 7/1904 | Kise | 339/176 P |
| 2,469,397 | 5/1949 | Mezek | 339/196 M |
| 3,706,065 | 12/1972 | Knitter et al. | 339/196 M |
| 4,283,103 | 8/1981 | Forberg et al. | 339/59 M |
| 4,410,225 | 10/1983 | Stoewe et al. | 339/31 R |

FOREIGN PATENT DOCUMENTS

| | | | |
|---|---|---|---|
| 1135541 | 8/1962 | Fed. Rep. of Germany . | |
| 2311809 | 3/1973 | Fed. Rep. of Germany . | |
| 151353 | 9/1920 | United Kingdom | 339/176 P |

OTHER PUBLICATIONS

Coaxial Cable to Printed Circuit Board Connector, Agard et al, IBM Technical Disclosure Bulletin, vol. 13, No. 6, Nov. 1970.

*Primary Examiner*—E. Michael Combs

*Attorney, Agent, or Firm*—St. Onge Steward Johnston & Reens

[57] ABSTRACT

A multipolar plug has a two-piece plastic housing which partially confines one or more one-piece synthetic plastic inserts each of which has a centrally located retaining section removably engaging the housing and a two-part second section. One part of the second section is confined in the housing, and the other part constitutes one or more prongs which can enter a receptacle to engage their contact members with complementary contact members in the receptacle. Each second section carries two or four discrete strip-shaped contact members which are blanked from sheet metal and have central portions fully embedded in the respective retaining section. Each contact member further includes a second portion which is partially embedded in the first part of the respective second section, and a third portion which is partially embedded in the second part of the respective second section. The contact members are disposed, either singly or in pairs, at the opposite sides of the respective second section.

8 Claims, 12 Drawing Figures

MULTIPOLAR PLUG

BACKGROUND OF THE INVENTION

The present invention relates to mutlipolar switches, and more particularly to improvements in multipolar switches of the class disclosed in commonly owned U.S. Pat. No. 4,410,225 to Stoewe et al.

The patented multipolar plug comprises a plate-like carrier with printed conductor tracks. If the plug is a four-pole plug, it comprises two prongs each of which carries two printed contact blades. An insert of the plug is installed in a two-piece housing and carries the contact elements. Such insert is further provided with extensions which are disposed between pairs of contact elements and are provided with latching bosses receivable in complementary latching elements of a terminal board.

A drawback of the patented plug is that the printed conductor tracks are subjected to pronounced wear in response to repeated insertion of the plug into or its withdrawal from a receptacle, such as the aforementioned terminal board. Furthermore, the conductor tracks tend to become separated from the carrier and thus prevent the establishment of reliable contact with the complementary conductors in the terminal board.

German Offenlegungsschrift No. 23 11 809 discloses a modified plug which is intended for use in the communications field. Such plug comprises a synthetic plastic body having an enlarged portion which is formed with slots, and strip-shaped metallic contact members which are inserted into the slots. The end portions of the contact members are bent along arcs of 180 degrees and extend into complementary grooves at the ends of the respective prongs. Those portions of the contact members which are adjacent to the enlarged portion of the plastic body are bent outwardly in order to properly engage the complementary contact elements. Male latching elements on the contact members extend into complementary female latching elements of the plastic body adjacent to the enlarged portion. The just described plug exhibits the advantage that it need not be provided with a discrete housing. However, the plug is rather expensive because the contact members must be machined and shaped in a series of successive operations.

German Auslegeschrift No. 11 35 541 discloses a plug wherein portions of the contact members are embedded in a carrier of insulating synthetic plastic material. Bare ends of the contact members extend from the carrier and can be inserted into the slots of a receptacle by using the carrier as a handle.

OBJECTS AND SUMMARY OF THE INVENTION

An object of the invention is to provide a multipolar plug which can be produced at a reasonable cost and is more versatile than heretofore known plugs.

Another object of the invention is to provide a multipolar plug which can be converted from a bipolar into a four-pole or six-pole plug or vice versa.

A further object of the invention is to provide a plug which is constructed in such a way that its contact members are less likely to undergo pronounced wear and/or to become separated from their carrier or carriers than the contact members of heretofore known multipolar plugs.

An additional object of the invention is to provide a novel and improved method of assembling a multipolar plug.

Still another object of the invention is to provide novel component parts for assembly into the improved multipolar plug.

Another object of the invention is to provide a multipolar plug whose component parts can be mass-produced in available machines.

The invention is embodied in a plug which comprises a housing (e.g., a two-piece housing consisting of two mirror symmetrical shells made of a suitable electrically insulating synthetic plastic material), and a one-piece synthetic plastic insert which is also made of an electrically insulating material and includes (a) a retaining section which is at least partially captured in and held by the housing and (b) a second section having first and second sides. The plug further comprises at least one electric contact member at each side of the second section. Each contact member has a first portion which is or which can be fully confined in the retaining section of the insert, and second and third portions which are partially embedded in the respective sides of the second section. The second portion of each contact member can be secured to a discrete conductor, and the third portion of each contact member is exposed so that it can be moved into current-conducting engagement with a complementary contact member in a receptacle for the corresponding part of the second section.

Each contact member preferably constitutes a simple sheet metal blank (i.e., a metallic piece which is obtained by blanking or a similar technique). The retaining section is preferably disposed between the second and third portions of each contact member, and the second portions of the contact members can be confined in the housing. The contact members are preferably elongated and include longitudinally extending marginal portions at least some of which are anchored in the second section. In accordance with a presently preferred embodiment, the second section of the insert comprises a first part which is confined in the housing and carries the second portions of the contact members, and a second part which is located outside of the housing and carries the third portions of the contact members. The aforementioned marginal portions are preferably anchored in the second part of the second section.

The second part of the second section serves as a means for facilitating introduction of third portions of the contact members into a receptacle. Each such third portion can comprise a relatively narrow elongated first component which extends longitudinally of and toward the free end portion of the second part, and a second component which is disposed at the free end portion of the second part. The width of each second component preferably equals or approximates the width of the free end portion of the second part. The second components of the third portions of contact members can be said to constitute terminals which are preferably bent around the free end portion of the second part of the second section so as to extend toward each other.

The first part of the second section is preferably provided with a discrete hole for each of the contact members, and such holes can receive portions of electrical conductors which are connected with the respective contact members, preferably in the interior of the housing.

The improved plug can comprise at least one additional one-piece synthetic plastic insert including an additional retaining section which is captured in the housing and an additional second section which can carry two or more contact members. One of the retaining sections is preferably provided with an integral male latching element (e.g., a projection extending laterally of the one retaining member), and the other retaining section is then provided with a female latching element (e.g., a latching element having a socket) which receives the male latching element.

The second part of each insert is preferably formed with a longitudinally extending side face and includes a detent member which extends from such side face and serves to ensure reliable retention of the second part of the respective second section in a receptacle. The detent member can constitute an integral portion of the respective insert.

DESCRIPTION OF THE PREFERRED EMBODIMENTS

Figure 1:
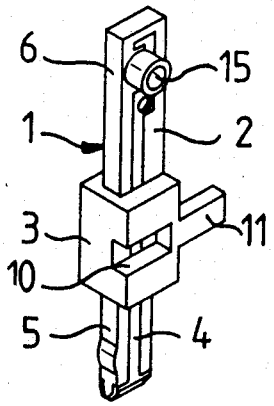
FIG. 1 is a perspective view of an insert for use in the housing of a two-pole plug.
Figure 2:
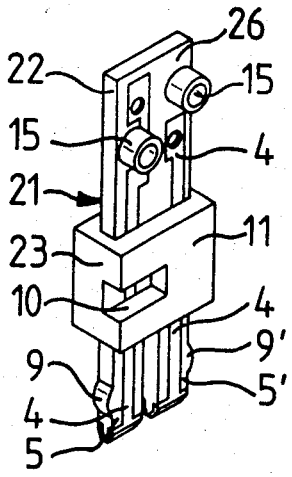
FIG. 2 is a similar perspective view of an insert for use in the housing of a four-pole plug.
Figure 3:
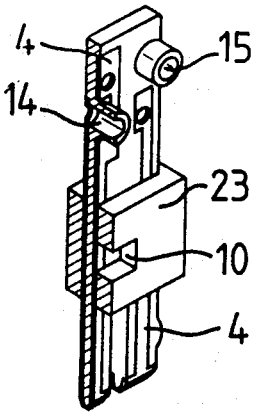
FIG. 3 shows the structure of FIG. 2 in a longitudinal sectional view through the insert and two of the four contact members.
Figure 9:
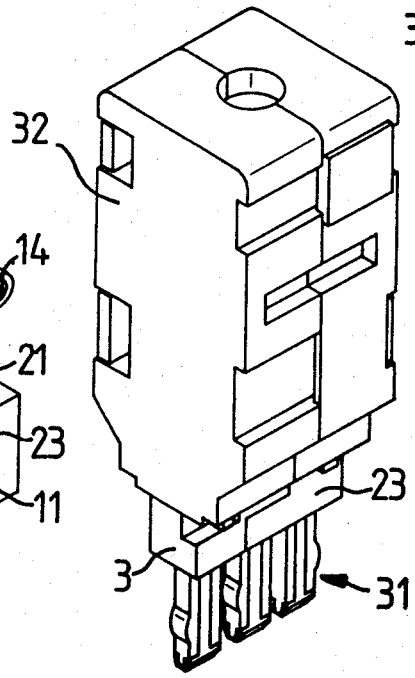
FIG. 9 is a perspective view of a fully assembled plug which includes the inserts of FIG. 4 and a two-piece housing.
Figure 5:
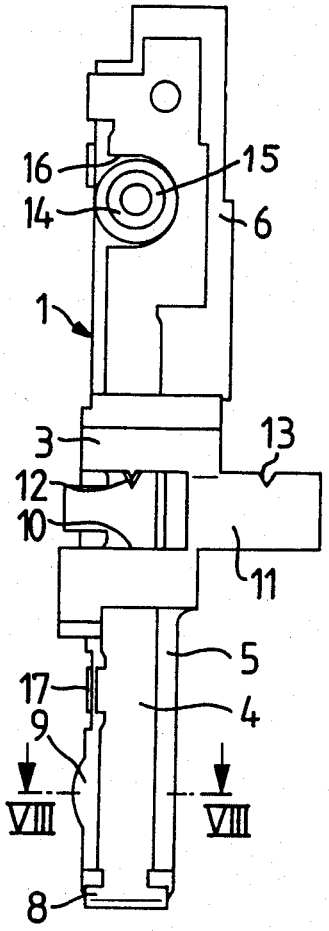
FIG. 5 is an enlarged side elevational view of the insert which is shown in FIG. 1.
Figure 6:
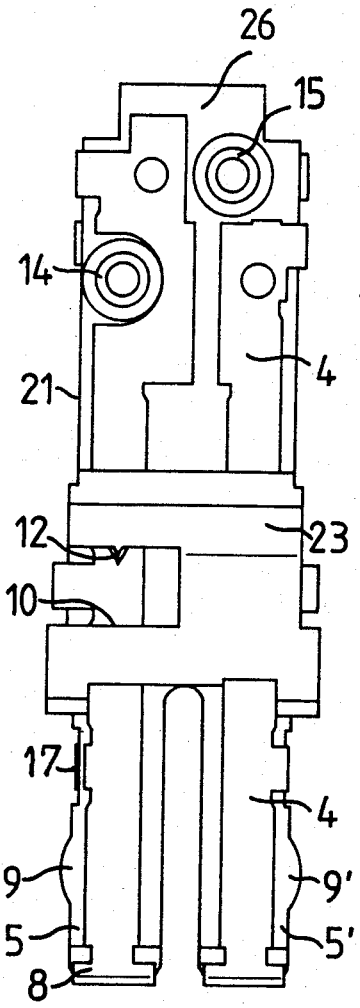
FIG. 6 is a similar enlarged side elevational view of the insert which is shown in FIG. 2.
Figure 8:
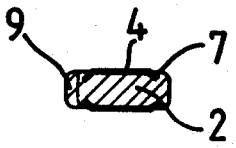
FIG. 8 is a sectional view as seen in the direction of arrows from the line VIII—VIII of FIG. 5.

Referring first to FIGS. 1, 5 and 8, there is shown an elongated insert 1 which can be assembled with a preferably two-piece housing (similar to the housing 32 of FIG. 10) into a two-pole plug. The insert 1 comprises a block-shaped retaining section 3 which can be partially captured in a housing (note FIG. 9) and an elongated second section 2 having a first contact-carrying part 6 and a second contact-carrying part 5. The entire insert 1 consists of a single piece of electrically insulating plastic material and the parts 5, 6 of the second section 2 have two relatively wide sides or surfaces alternating with two relatively narrow side faces (see FIG. 8). It is presently preferred to mass-produce the entire insert 1 in an injection molding machine in such a way that the insert is properly assembled with two elongated contact members 4. The retaining section 3 is disposed at least substantially midway between the parts 5, 6 of the section 2, and each contact member 4 has a median or first portion which is fully embedded and confined in the retaining section 3, a second portion which is partially embedded in the part 6 of the section 2 so that one of its major sides is exposed at the respective side or surface of the part 6, and a third portion which is partially embedded in the part 5 in such a way that one of its sides is exposed along the respective side or surface of the part 5. Each contact member 4 preferably constitutes a simple metallic blank which is obtained by blanking or an analogous mass-producing technique. The manner in which the blanks which constitute the contact member 4 are partially embedded in the parts 5 and 6 of the second section 2 of the insert 1 can be readily seen in FIG. 8. The longitudinally extending marginal portions 7 of the contact members 4 are slightly bent and are embedded in the material of the respective parts 5, 6, particularly in the part 5 (see FIG. 8) so that the exposed side of each contact member extends slightly beyond the respective side or surface of the section 5 or 6. Furthermore, the width of those (elongated first) components of the contact members 4 which extend along the part 5 is less than the width of the respective side faces. On the other hand, the width of the second component or terminal 8 of each contact member 4 in the region of the free end portion of the part 5 matches or approximates the width of the respective side or surface of the part 5. This can be readily seen in FIGS. 1 and 5.

Figure 10:
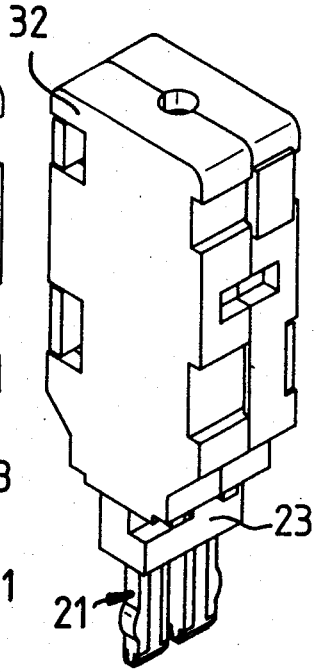
FIG. 10 is a perspective view of a fully assembled plug which includes the insert of FIG. 2.
Figure 11:
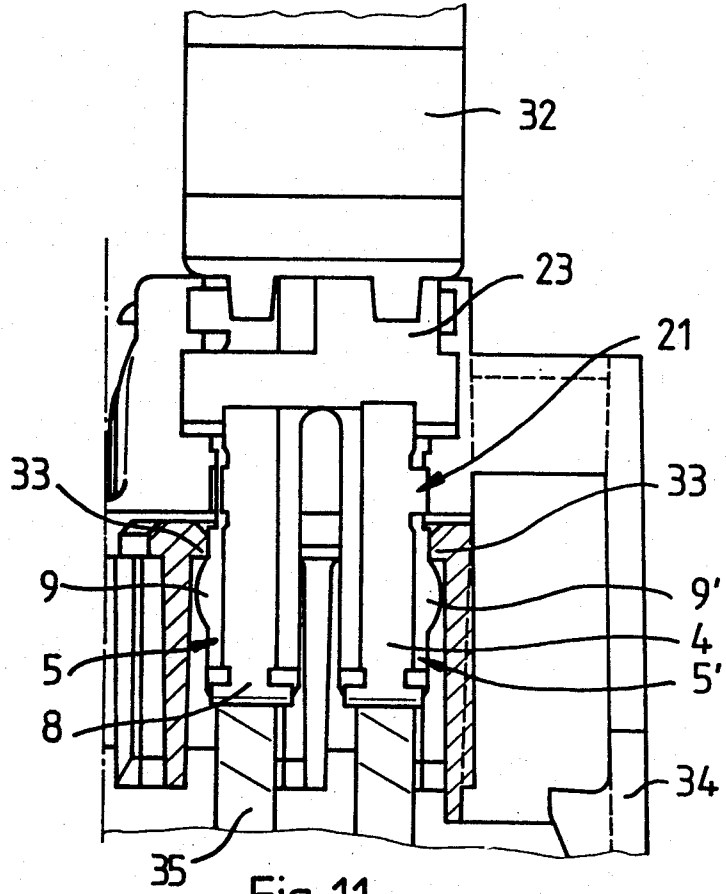
FIG. 11 is an enlarged fragmentary partly side elevational and partly sectional view of a terminal board and of the plug which is shown in FIG. 10.

One narrower side face of the part 5 is formed with a protuberance in the form of a lobe 9 constituting a male detent member which can span into a complementary female detent member when the part 5 of the second section 2 is inserted into a receptacle (see the female detent members 33 in FIG. 11). The detent member 9 is preferably an integral portion of the insert 1. The exposed side of the detent member 9 is substantially convex with gradual transition into the adjacent portions of the respective side face on the part 5 to ensure convenient insertion of the part 5 into or convenient extraction of such part from a female detent member 33. The female detent members 33 which are shown in FIG. 10 form part of a strip-shaped receptacle or terminal board 34 defining a socket for two prongs 5, 5' of the second section of a modified insert 21 which is shown in FIGS. 2, 3, 6 and 7.

The centrally located retaining section 3 of the insert 1 is formed with a laterally extending male latching element 11 which is an elongated parallelepiped projection receivable in a complementary female latching element or socket 10 provided in an adjacent insert, such as the insert 21 of FIGS. 2, 3, 6 and 7. The manner in which the male latching element 11 can be inserted into the female latching element 10 of an adjacent insert 21 can be seen in FIG. 4. The section 3 is also formed with a female latching element 10 which can receive the latching element 11 of an adjacent section 3 or a modified section. The cross-sectional area of the section 3 exceeds the cross-sectional area of the part 5 or 6 of the section 2.

The female latching element 11 has one or more relatively small tooth-shaped pallets 12 which can snap into the complementary notch or notches 13 of the male latching element 11 on an adjacent section 3. The detent structure including the pallet or pallets 12 and the corresponding notch or notches 13 renders it possible to reliably retain a male latching element in the selected female latching element and to thus more or less positively but separably couple two adjacent inserts to each other.

The part 6 of the section 2 is formed with two integral sleeve-like extensions 15, one for each of the contact members 4, and each such extension defines a hole 14 for reception of a portion of an electrical conductor which is to be electrically connected to the respective contact member. The sleeves 15 are partially received in recesses 16 which are provided therefor in the contact members 4. Each sleeve 15 extends from one side or surface of the part 6. As can be seen in FIG. 5, a sleeve 15 extends from each side or surface of the part 6, and each of these sleeves insulates the respective conductor from the adjacent contact member 4. Each of the recesses 16 is bounded by a concave surface of the respective contact member 4.

The contact members 4 are preferably provided with lugs 17 (one shown in FIG. 5) which facilitate the insertion of such contact members into the cavity of an injection molding machine prior to making of the respective insert 1. The lugs 17 can be broken off or otherwise removed upon completion of the injection molding operation. The lugs 17 of a full battery of discrete contact members 4 can be installed in a suitable frame before the latter is inserted into the injection molding machine.

FIGS. 2, 3, 6 and 7 show the insert 21 of a four-pole plug which further comprises a two-piece housing 32 (see FIGS. 10, 11 and 12) preferably consisting of two mirror symmetrical half shells made from a suitable insulating synthetic plastic material. The insert 21 comprises a retaining section 23, which corresponds to the retaining portion 3 of the insert 1, and a two-part second section 22. The first part 26 of the section 22 corresponds to the part 6 of the section 2 and carries portions of four contact members 4. The other part of the second section 22 of the insert 21 comprises two elongated prongs 5, 5' each of which corresponds to the part 5 of FIGS. 1, 5 and 8. Thus, the prong 5 carries portions of two contact members 4 with terminals 8 and removable lugs 17, and includes a lobe 9 for engagement with a socket 33. The prong 5' has a lobe 9'. The insert 21 is analogous to the insert 1 except that it is designed to carry four discrete contact members 4 and that the part which is to enter a receptacle comprises two discrete prongs 5, 5'. Furthermore, the part 26 of the second section 22 of the insert 21 is provided with four integral insulating sleeves 15 defining holes 14 for reception of conductors which are to be electrically connected to the respective contact members 4. Two sleeves 15 extend from each of the two major sides or surfaces of the part 26. The retaining section 23 is formed with a female latching element 10 having one or more pallets or teeth 12 and serving to receive a laterally extending male latching element 11, e.g., in a manner as shown in FIG. 4.

Figure 7:
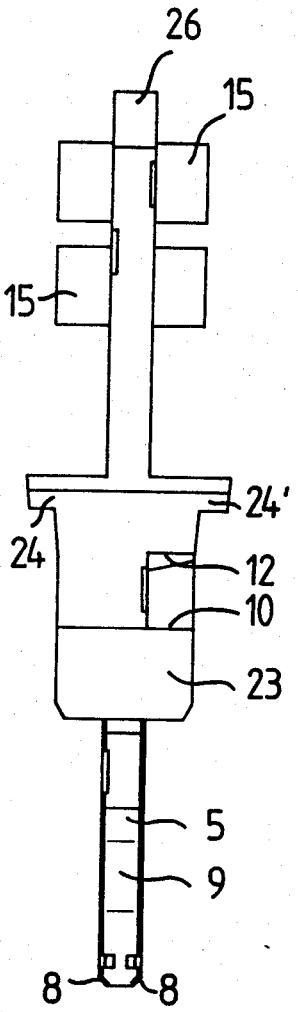
FIG. 7 is an end elevational view of the structure which is shown in FIG. 6.

FIG. 7 shows that two opposing sides of the retaining section 23 are provided with locking projections 24, 24' in the form of ledges which can be received in complementary recesses of the housing 32 to ensure reliable retention of a portion of the section 23 in the housing. FIG. 7 further shows that the relatively short second components or terminals 8 of the contact members 4 in the regions of the free end portions of the respective prongs 5, 5' are suitably bent so that they extend toward each other and facilitate introduction of the prongs into a receptacle. The width of the terminals 8 equals or approximates the width of the major sides or surfaces of the respective prongs 5, 5'.

Figure 4:
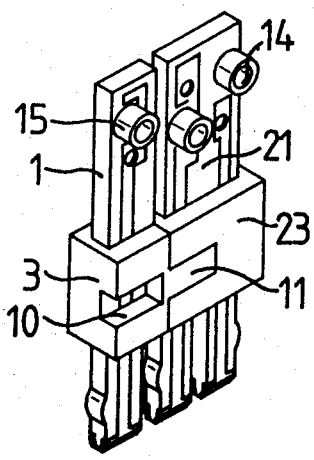
FIG. 4 is a perspective view of the inserts which are shown in FIGS. 1 and 2 and are separably connected to each other by complementary male and female latching elements.

FIG. 4 illustrates the manner in which the inserts 1 and 21 can be separably coupled to each other by causing the male latching element 11 of the section 3 to enter the female latching element 10 of the section 23. At such time, the pallet 12 in the latching element 10 extends into the notch 13 of the latching element 11. The thus assembled inserts 1 and 21 can be installed in the modified two-piece housing 32' of FIG. 9. The resulting structure is a six-pole plug 31 with three pairs of partially exposed contact members 4, namely, a first pair on the part 5 of the section 3 of the insert 1, a second pair on the prong 5 of the second section 22 of the insert 21, and a third pair on the prong 5' of the second section 22 on the insert 21. The housing 32' may be of the type disclosed in the aforementioned commonly owned U.S. Pat. No. 4,410,225 whose disclosure is incorporated herein by reference, i.e., it can comprise two mirror symmetrical half shells which are made from an insulating material and each of which has several latching projections removably received in complementary openings of the other half shell. Moreover, the ledges 24, 24' of the retaining section 23 of the insert 21 are received in complementary recesses of the two half shells of the housing 32'.

Figure 12:
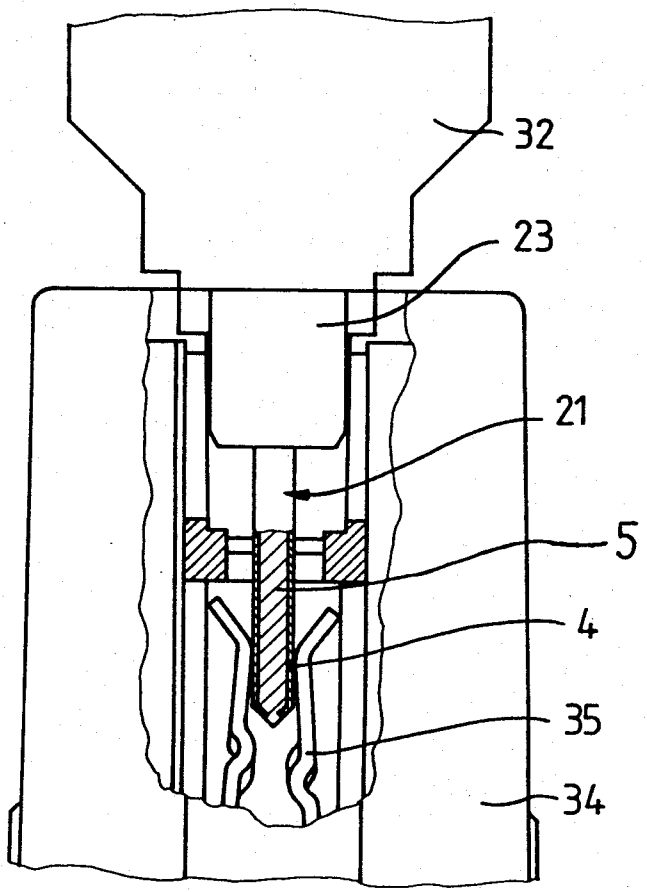
FIG. 12 is a partly end elevational and partly sectional view of the structure which is shown in FIG. 11.

FIG. 10 shows the two-part housing 10 for the insert 21 of FIGS. 2, 3, 6 and 7. The thus obtained four-pole plug is removably insertable into the synthetical plastic strip of the terminal board 34 which is shown in FIGS. 11 and 12. The male detent members 9, 9' of the prongs 5, 5' are removably received in the corresponding female detent members 33. As can be seen in FIG. 12, the terminals of two contact members 4 on each of the prongs 5, 5' are received between elastically deformable contact members 35 which are installed in the board 34. The construction of the terminal board 34 is or can be similar to or identical with that of the terminal board which is disclosed in commonly owned U.S. Pat. No. 4,283,103 whose disclosure is incorporated herein by reference.

An important advantage of the improved plug is its simplicity as well as its versatility and low cost. The contact members 4 can be mass-produced by blanking and they can be permanently assembled with the respective inserts 1 or 21 during mass-production of the inserts in an injection molding or other suitable machine. Each of the inserts 1 or 21 is a one-piece body made from a suitable synthetic plastic material. The feature that the median portions of the contact members 4 are fully embedded in the respective retaining section 3 or 23 and that the first and second portions of the contact members 4 are partially embedded in the respective parts (such as 6, 5 or 26, 5, 5') of the second section 2 or 22 of the insert 1 or 21 ensures that the contact members 4 are subjected to negligible wear as well as that they cannot become separated from the respective inserts regardless of the frequency of insertion or extraction of the second part of the second section into and from a receptacle. The improved plug can be used with particular advantage in telephone systems and other types of communications equipment.

The feature that the marginal portions of the third portion of each contact member 4 are embedded in the respective part 5 or 5, 5' also contributes to longer useful life of the improved plug. Such embedding of the marginal portions 7 into the material of the slender second part of the respective second insert section 2 or 22 has been found to reliably prevent separation of the third portions of contact members 4 from the rather slender prongs which constitute the second parts of the respective second sections. Widening of the terminals 8 of contact members 4 ensures that such contact members reliably engage the complementary contact members 35 in the receptacle. Moreover, such widening of the terminals 8 reduces the likelihood of premature wear upon the foremost ends of the contact members 4.

We claim:

1. A plug comprising a housing; a one-piece synthetic plastic insert including a retaining section captured in said housing and a second section having a first part which is confined in said housing and a second part which is located outside said housing, said second section having first and second sides; and at least one electric sheet metal elongated contact member at each side of said second section, each of said contact members having a first portion located on said first part and confined in said retaining section, said contact members further having second and third longitudinally extending marginal portions respectively anchored in the first and second parts of the second section and being partially embedded in the respective sides of said second section, with the retaining section disposed between the second and third portions of the contact members and with said second portions being confined on said first part in said housing.

2. The plug of claim 1, wherein said second section second part has an end portion remote from said housing and has a predetermined width, the third portions of said contact members being partially embedded in said second part of said second section and each of said third portions including a first component having a width less than said predetermined width and a second component disposed at the end portion of said second part and having a width which at least approximates said predetermined width.

3. The plug of claim 1, wherein said second section second part has an end portion remote from said housing, the third portions of said contact members being partially embedded in said second part of the said second section and having terminals disposed at the end portion of said part and extending toward each other.

4. The plug of claim 1, further comprising an additional one-piece synthetic plastic insert including an additional retaining section captured in said housing and an additional second section, one of said retaining sections having a male latching element and the other of said retaining sections having a female latching element receiving said male latching element.

5. The plug of claim 4, wherein said female latching element has a socket and said male latching element has a projection extending laterally of said one retaining section and into said socket.

6. The plug of claim 1, wherein said second section has an elongated part which extends from said housing and has a longitudinally extending side face provided with a detent member for retention of said part in a receptacle.

7. The plug of claim 6, wherein said detent member is an integral portion of said insert.

8. The plug of claim 1, wherein said housing comprises two substantially mirror symmetrical half shells containing an electrically insulating synthetic plastic material.

* * * * *